United States Patent [19]

Vidas

[11] Patent Number: 4,624,492

[45] Date of Patent: Nov. 25, 1986

[54] DOOR LOCKING AND RESTRAINING MECHANISM

[76] Inventor: Aaron L. Vidas, 461 Ann St., West Chicago, Ill. 60185

[21] Appl. No.: 780,981

[22] Filed: Sep. 27, 1985

[51] Int. Cl.[4] ..... E05C 17/32

[52] U.S. Cl. ..... 292/263; 292/269

[58] Field of Search ..... 292/269, 273, 263, 264, 292/277, 262, 270, 57, 109

[56] References Cited

U.S. PATENT DOCUMENTS

| | | | |
|---|---|---|---|
| 388,074 | 8/1888 | Reardon | 292/269 |
| 530,316 | 12/1894 | Yates | 292/269 |
| 1,126,969 | 2/1915 | Foerster | 292/262 |
| 1,988,237 | 1/1935 | Chisling | 292/263 |
| 2,368,411 | 1/1945 | Chambers | 292/269 |
| 3,322,453 | 5/1967 | Nagai | 292/269 |

FOREIGN PATENT DOCUMENTS

| | | | |
|---|---|---|---|
| 132853 | 7/1902 | Fed. Rep. of Germany | 292/263 |

*Primary Examiner*—Henry E. Raduazo
*Attorney, Agent, or Firm*—Douglas B. White

[57] ABSTRACT

There is provided an improved door locking and restraining device which employs a reciprocating bolt to secure the door closed when in a first position by engagement of the bolt with a locking plate. With the bolt in a second position, extension levers attached to the locking plate are engaged to allow secure limited opening of the door.

1 Claim, 3 Drawing Figures

DOOR LOCKING AND RESTRAINING MECHANISM

BACKGROUND OF THE INVENTION

The present invention relates generally to door locks and more particularly to locking devices which allow selective limited opening of a door.

Previous devices have principally been limited to bolt and chain locks of the type documented in U.S. Pat. No. 1,479,709 and commonly seen in the market, whereby a bolt reciprocates within a barrel to selectively lock a door in its closed position. When the bolt is disengaged, a selectively detachable chain remains to hold the door from opening beyond a limited amount. While this system has been in use for years, the chain mechanism has generally proven to be breakable by intruders. Consequently, a sturdier system has been required but to date had not been developed.

SUMMARY OF THE INVENTION

Acccordingly, it is a principal object of the present invention to provide a door locking mechanism which will, in one mode, secure a door in a fully closed position and, in a second mode, allow the limited opening of the door. There is generally provided herein a door bolt and lock system which when the bolt is in a first position securely holds the door fully closed, and when the bolt is in a second partially withdrawn position allows the door to open only a limited amount by action of its engagement with pivoting levers attached to the door frame. In its fully closed position, the bolt protrudes through the pivoting levers to a single locking orifice. In this position the shaft of the locking bolt protrudes through the aligned slots in the lever members and into the orifice of the locking plate to secure the door in the locked position. In the partially withdrawn position, the bolt does not engage the locking orifice but engages slots in the upper and lower pivoting levers. This allows the levers to pivot freely about their points of attachment at the door jamb while retaining the bolt member at their outer extremities to allow limited opening of the door.

Other objects and advantages of the invention will become apparent upon reading the following detailed description and upon reference to the drawings.

While the invention will be described in connection with the preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
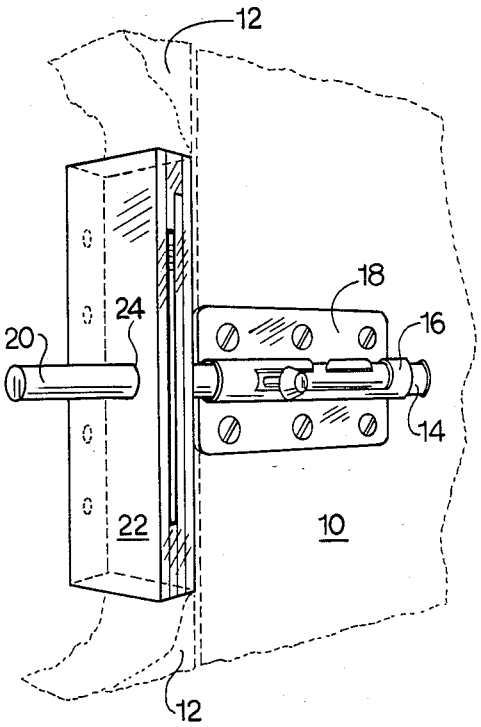
FIG. 1 is a pictorial view of the door lock mechanism of the present invention showing the bolt in a fully closed and locked position.

Turning to FIG. 1, there is shown generally the door locking and restraining mechanism of the present invention in a fully closed and locked position. A door 10 is shown closed against a door jamb 12. A shaft 14 positioned within a barrel 16 is arranged to slidably reciprocate therein for selective positioning. This barrel is formed as part of a mounting plate 18 and arranged to be attached to the door by appropriate attachment means such as screws.

Figure 3:
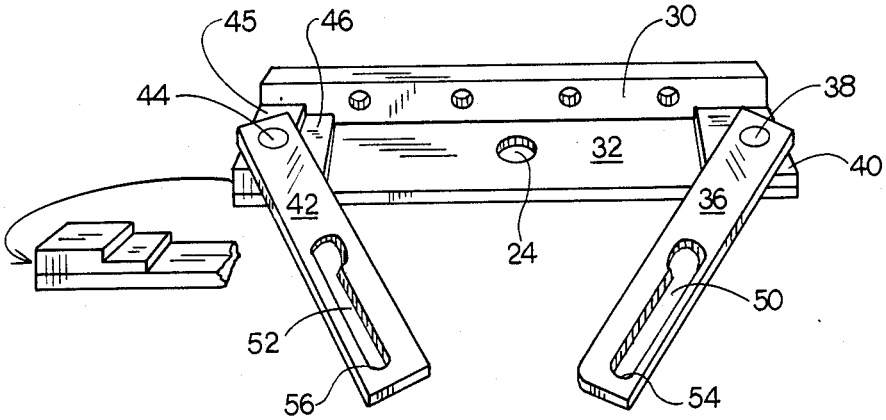
FIG. 3 is a pictorial view of the door jamb attachment member showing the pivoting lever mechanisms in more detail.

For receiving the protruding end 20 of the shaft 14 there is provided in the present invention a locking mechanism 22, more fully described below. This mechanism has positioned therein a single orifice 24 arranged to receive the shaft 14 of locking bolt mechanism and secure the same therein. This locking mechanism 22, more clearly shown in FIG. 3, is arranged to be affixed to a door jamb at its mounting plate 30 by attachment means such as screws. Proximate to and longitudinally aligned with the attachment plate 30 thate is provided the base locking plate 32 having a single orifice arranged at substantially the center thereof for receiving the shaft 14 of the locking bolt. At a first end thereof there is provided a first lever 36 attached at one extremity to the locking plate by a shaft 38 and arranged for pivotal motion thereabout. This lever is spaced from the locking plate by a spacer 40. At the opposite end of the locking plate there is provided a second lever 42 attached at one extremity to the locking plate by a shaft 44 and arranged for pivotal motion thereabout. This lever is similarly spaced from the locking plate by dual spacers 45 and 46 such that clearance will be provided between this second lever and the first lever mounted at the other extremity of the locking plate.

Within the first and second levers there are provided longitudinally aligned slots 50 and 52 respectively arranged to overlie in registration with the orifice in the locking plate when both levers are fully closed against the locking plate as shown in FIG. 1.

Figure 2:
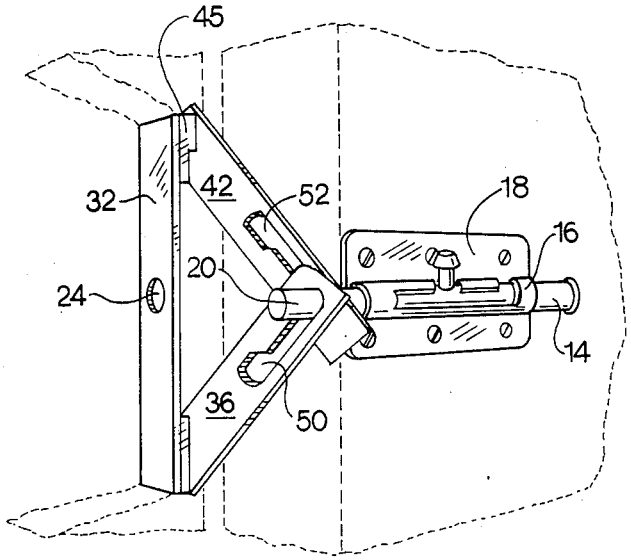
FIG. 2 is a pictorial view of the door lock mechanism of the present invention showing the bolt in its partially withdrawn position and engaging only the pivoting lever members of the door lock mechanism.

The transition of the mechanism from a fully closed and locked position to the partially opened position can be more easily understood by reference to FIG. 2. In the fully closed position as shown in FIG. 1, the shaft of the locking bolt protrudes through the registered slots 50 and 52 of the lever members and into the locking orifice of the locking plate. When in this position, the door cannot be opened. When the shaft of the locking bolt is withdrawn to a second position as shown in FIG. 2, the shaft of the locking bolt disengages the locking orifice 24 while remaining engaged with the registered slots 50 and 52 of the levers. Thusly, the door may be opened to a degree limited by the combined extension of the levers as they rotate, allowing the shaft of the locking bolt to slide to the furthest extremties 54 and 56 of the respective levers. At such time that it is desired to fully open the door, the shaft of the locking bolt is fully withdrawn from engagement with the levers of the locking mechanism, allowing them to be pivoted back within the locking mechanism and allowing the door to open freely without restraint from the lever members.

In summary, there has been shown a door lock system which employs a reciprocating bolt to secure the door closed when in a first position by engagement of the bolt with a locking plate. With the bolt in a second position, extension levers attached to the locking plate are engaged to allow secure limited opening of the door.

I claim:

1. A locking device for locking a door to a door jamb comprising:

a bolt member mounted to the door for selective reciprocal motion;

a locking plate mounted to the door jamb and having located therein an orifice arranged to receive said bolt member;

a first extension member pivotally mounted to one extremity of said locking plate and having a bolt member receiving slot defined in said first extension member and arranged to overlie said orifice in said locking pate while said first extension member is in a first position and to maintain engagement with said bolt member when said first extension member is pivoted out of said first position; and a second extension member pivotally mounted to said locking plate at its extremity opposite said first extension member and having a bolt member receiving slot defined therein arranged to overlie said orifice in said locking plate while said second extension member is in a first position and to maintain engagement with said bolt member when said second extension member is pivoted out of said first position.

* * * * *